United States Patent [19]

Supik et al.

[11] 4,309,951

[45] Jan. 12, 1982

[54] METHOD FOR DEBURRING SHEET METAL PARTS, SUCH AS CAN COVERS

[75] Inventors: Helmuth Supik, Brunswick; Hans-Juergen Schlinsog, Cremlingen, both of Fed. Rep. of Germany

[73] Assignee: Schmalbach-Lubeca GmbH, Brunswick, Fed. Rep. of Germany

[21] Appl. No.: 210,865

[22] Filed: Nov. 26, 1980

[30] Foreign Application Priority Data

Dec. 13, 1979 [DE] Fed. Rep. of Germany ..... 2950214

[51] Int. Cl.[3] ..... B21D 51/40; C25F 3/14

[52] U.S. Cl. ..... 413/18; 204/129.65

[58] Field of Search ..... 204/129.65, 129.55, 204/129.1; 113/116 V, 121 R, 121 C

[56] References Cited

U.S. PATENT DOCUMENTS

| | | | |
|---|---|---|---|
| 2,122,463 | 7/1938 | Fuller | 204/129.65 |
| 2,382,549 | 8/1945 | Edmonson | 204/129.1 |
| 2,479,302 | 8/1949 | Bondley | 204/129.1 |
| 2,725,352 | 11/1955 | Strobel | 204/28 |
| 3,691,654 | 9/1972 | Siegel | 29/25.18 |

*Primary Examiner*—T. M. Tufariello

*Attorney, Agent, or Firm*—W. G. Fasse; D. H. Kane, Jr.

[57] ABSTRACT

Sheet metal parts such as can covers, or the like, are deburred around the edges by an electrochemical treatment step in which the sheet metal to be deburred forms the anode in an alkaline electrolytic bath. The material removal is substantially limited to the location of the stamping burrs and edges around holes in the sheet material by controlling the current flow or current density in response to the physical size of the burr which is mechanically sensed and by properly limiting the duration of the current flow.

4 Claims, 4 Drawing Figures

FIG. 1
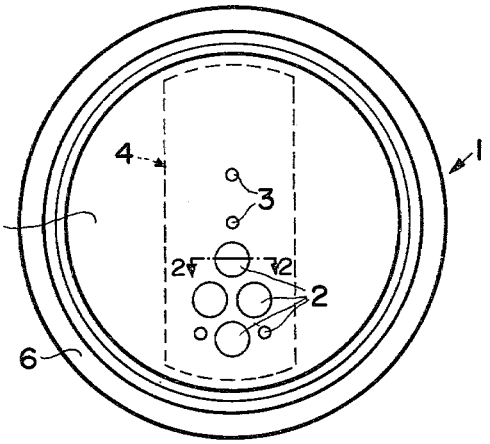
FIG. 2
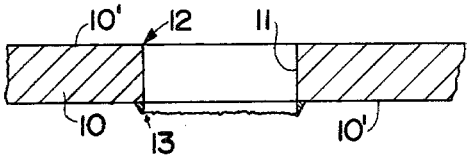
FIG. 3
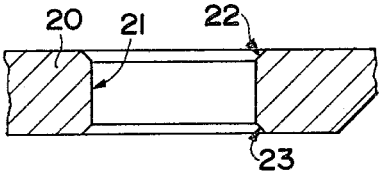
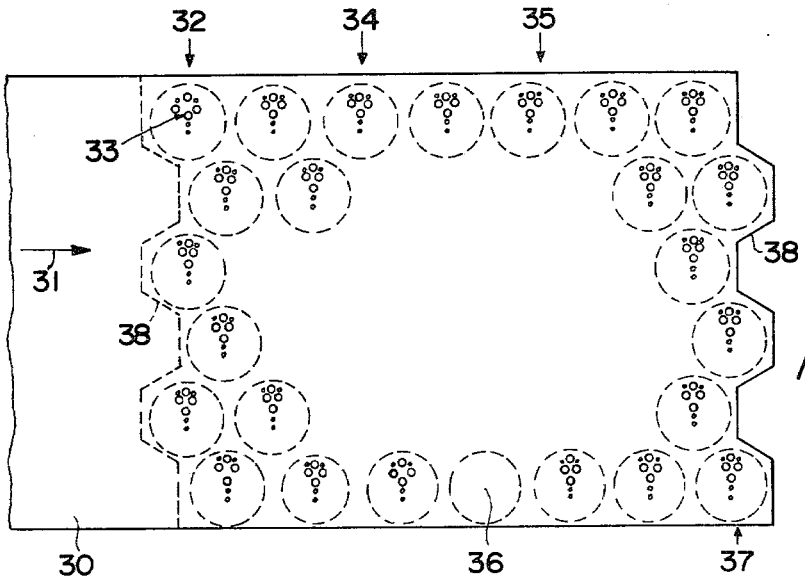
FIG. 4

METHOD FOR DEBURRING SHEET METAL PARTS, SUCH AS CAN COVERS

CROSS-REFERENCE TO RELATED APPLICATIONS

The present application corresponds to German patent application No. 2,950,214.5, filed in the Federal Republic of Germany on Dec. 13, 1979. The priority of said German filing date is hereby claimed.

BACKGROUND OF THE INVENTION

The present invention relates to a method for deburring sheet metal parts, such as can covers. More specifically, the invention relates to a method for producing can covers of sheet metal, particularly iron or steel sheet metal for containers especially cans for canning purposes. The blanks for such sheet metal parts, especially can covers, are stamped from sheet metal in the form of panels or continuous coils of sheet metal. Especially in connection with can covers provided with so-called rib tops the covers are stamped to have one or several openings therein for emptying the can and to provide a venting for facilitating the content removal. These openings in the can cover are surrounded by burrs along their edges due to the stamping operation. It is also known to provide the can covers after the stamping operation with protective coatings which are supposed to satisfactorily cover the burrs.

Thereafter, the holes in the cover are provided with a hermetic seal in the form of a flexible rib strip which is secured to the top of the cover either by an adhesive or by a so-called hot seal.

Covers of the type described above are known in the art, for example, from U.S. Pat. No. 3,292,828 or German Patent Publication (DE-AS) No. 2,519,709. Additionally, the present invention is applicable generally to all types of sheet metal parts having burrs including covers with only one hole either for the purpose of removing the can content and/or for venting the can.

The production by stamping, inevitably results in the formation of a burred edge around the stamped hole or holes and such burred edges have been the cause of problems such as injuries to the user, difficulties in providing a proper seal, corrosion problems which start along the burrs and may result in the spoiling of the can content, and so forth.

Attempts to avoid the just mentioned problems included providing the can cover on the side carrying the burrs with a respectively thick lacquer layer in which the stamping burr is embedded. However, a complete, continuously effective embedding of the burr is difficult and expensive because it requires continuous monitoring of the coating operation and the coating method is accordingly rather expensive. The burrs generally have an uneven configuration and therefore the complete coating of the burrs is difficult. Thus, corrosions may start in spots where parts of the burrs protrude from the coating. Also, in connection with can covers made of steel or iron sheet material a proper protective coating by tin plating or chromium plating could not be established satisfactorily heretofore, especially if one aims at providing a reliable and yet inexpensive coating operation for preventing the corrosion problems in the area of the stamping burrs. Similar problems may occur in connection with other types of sheet metals such as aluminum sheet metal or the like.

OBJECTS OF THE INVENTION

In view of the above it is the aim of the invention to achieve the following objects singly or in combination:

to avoid the above difficulties and to improve the above mentioned production method in such a manner that the stamping burrs are effectively removed without impairing in any way the sequence or effectiveness of the other manufacturing steps;

to remove the burrs effectively so as to avoid the above corrosion and other problems;

to provide a means for removing stamping burrs while simultaneously permitting a rounding of openings or edges in sheet metal parts which do not necessarily have a burr;

to avoid embedding the burrs in a lacquer layer; and to integrate the deburring step into the remaining manufacturing sequence without interfering with the latter.

SUMMARY OF THE INVENTION

According to the invention the stamping burrs are removed from sheet metal parts subsequent to the stamping step by an electrochemical treatment of the sheet metal to such an extent that the burrs are removed by galvanic action in a bath in which the sheet metal parts or at least the burrs thereof form the anode. Simultaneously with the removal of the stamping burrs it is possible to provide the edges around holes or the like of the sheet metal parts with a chamfer or bevel by the same electrochemical action. Thus, both surfaces of the sheet metal parts may have smooth edges, especially around holes in the sheet metal parts.

It has been found that the removal of the stamping burrs effictively prevents the starting of corrosion in the zone of the opening edges. Moreover the rounding or chamfering of the opening edges, especially on the side opposite the burr, facilitates the reliable and hermetic application of the flexible closing rib strip. A further advantage of the smooth edges, especially the edge facing the rib strip, is seen in that after application of the rib strip and under adverse loading conditions the edge of the sheet metal cover does not penetrate into the material of the rib strip, thereby avoiding weakening the rib strip to any undesired extent.

It has been found to be advantageous that the hole pattern may be stamped into the panel or coil type sheet material even prior to the stamping of the individual cover blanks. The protective coating is preferably applied to the entire sheet metal stock immediately after the stamping of the holes. Such protective coating may be in the form of a plating operation, for example, tin plating or chromium plating. This protective coating will limit the electrochemical deburring action to the burrs. However, the protective coating may also be applied subsequent to the deburring action, especially when the latter is precisely limited in time and when the current density of the electrochemical deburring treatment is concentrated on the burrs.

Where the protective plating is applied prior to the electrochemical deburring, a subsequent plating step may be employed to cover the deburred and rounded edges of the sheet metal parts. A protective lacquer coating has been obviated altogether according to the invention. The rounded edges around holes in the sheet metal parts permit the formation of a reliable, uniform application of the plating material, such as a tin or chromium plating, without any danger that sharp edges or burred edges remain. Thus, according to the invention the above mentioned corrosion problems have also been effectively eliminated in an especially simple manner and substantially without any additional expense because the deburring may be accomplished as part of the chemical cleaning treatment employed heretofore. Thus, it is also not necessary to use additional investment costs for the equipment employed in the present manufacturing of can covers or the like.

BRIEF FIGURE DESCRIPTION

In order that the invention may be clearly understood, it will now be described, by way of example, with reference to the accompanying drawings, wherein:

FIG. 1 illustrates a top plan view of a typical can cover that may be manufactured in accordance with the method of the invention;

FIG. 2 shows on an enlarged scale a sectional view along section line 2—2 in FIG. 1 to illustrate a single hole after the stamping operation;

FIG. 3 is a view similar to that of FIG. 2, showing the hole edges after the deburring operation according to the invention; and FIG. 4 is a top plan view of a band type steel sheet metal stock, whereby the band runs sequentially through schematically indicated method steps or manufacturing stations.

DETAILED DESCRIPTION OF PREFERRED EXAMPLE EMBODIMENTS AND OF THE BEST MODE OF THE INVENTION

FIG. 1 shows the top plan view of a cover 1 for a can provided with a group of closely spaced holes 2 arranged in the face 5 of the cover 1. A single hole may be provided or a group of holes forming a predetermined pattern. The holes 2 are, for example, for the purpose of removing the liquid content from the can after tearing the rip strip 4 off the cover 1. The holes 3 are venting holes for venting the inner volume of the can when the content is being poured out. The cover 1 is provided with a conventional rim 6 which is conventionally connected to the rim of a container body, for example, by a folded rabbet joint not shown since it is not part of the invention.

The holes 2 and 3 are sealed by a rip strip 4 indicated in dashed lines and made of a flexible material connected to the can cover, for example, by an adhesive or by a hot seal hermetically securing the rib strip to the outer surface 5 of the cover 1 as is conventional. The can may be opened by simply lifting the rip strip 4 to an extent sufficient to open the holes 2 and 3. The invention is not limited to the particular hole pattern shown in FIG. 1. One or several holes may be arranged in any pattern.

The covers 1 are made of sheet metal stock conventionally available in the form of panels or bands sold in coils. It is possible to first stamp the cover blanks out of the sheet metal panel or coil and to stamp the hole or holes thereafter and prior to further treatment. However, the preferred operation is to first stamp the hole or holes in such a manner that the sheet metal blanks remain within the panel or coil band for further subsequent treating prior to the final stamping operation or prior to severing the panel or band into a number of strips from which the blanks are to be stamped.

The invention is applicable substantially for any kind of sheet metal, such as aluminum sheet metal, iron or steel sheet metal, as is conventionally used for the production of can covers and having the conventional and suitable qualities.

FIG. 2 shows on an enlarged scale that the cover blank 10 after the stamping from the top downwardly for the formation of the hole or holes 11, is provided with a sharp edge 12 around the hole 11 at the top side and with a sharp burr 13 around the edge on the bottom side. The burr 13 protrudes substantially from the lower side of the blank 10 if one takes into account that the blank 10 is actually much thinner than shown in FIG. 2.

When now the protective plating 10′ is applied to both faces of the blank 10 the sharp edges 12 and the burrs 13 are also plated. However, due to the sharp edges, especially of the burr, the protective coating will not reach the required thickness in these zones 12 and 13. Accordingly heretofore it was not possible to avoid the above mentioned corrosion problem because sharp peaks of the burrs 13 could come into contact with the can content to provide a starting point for the corrosion, for example, where the burr was not covered at all or was uncovered again in the further processing of the can. Heretofore it happened that the content was spoiled by a change in the taste or color of the can content.

FIG. 3 shows that according to the invention the burr 13 and the sharp edge 12 may be completely removed by the electrochemical treatment disclosed herein. Thus, the blank 20 after the electrochemical treatment has a hole or holes 21, the edges of which are chamfered as shown at 22 and 23. The chamfer may also be rounded so that a smooth surface type transition is provided around the edges of the hole on both sides of the cover blank 20 from the surfaces of the blank into the surface defining the opening 21.

FIG. 4 illustrates the preferred manufacturing sequence. A sheet metal band or tape 30 is pulled off a coil and moved in the direction of the arrow 31 from left to right. The raw sheet metal or so-called black sheet is first subjected to a stamping operation in the station 32 to provide the holes 33. The dashed line marking the circles, indicates the future stamping line along which the blanks will be stamped out of the band or tape 30. Upon completion of the hole stamping in station 32 the band or tape 30 advances to station 34 in which the sheet metal is subjected to an electrochemical cleaning operation. According to the invention the electrochemical cleaning bath is adjusted in its composition and in its current density in combination with an adjustment of the residence time in the cleaning bath in such a manner that simultaneously with the cleaning operation the electrolytical current removes the burrs 13 and sharp edges 12 to achieve a blank 20 as shown in FIG. 3.

Upon leaving the cleaning and deburring station 34 the sheet metal is moved into the coating or plating station 35 in which preferably a tin plating and/or chromium plating takes place. Thereafter the sheet metal moves into a severing station 37 in which either the individual blanks 36 are stamped out along the dashed circle lines or strips are severed along the indented line 38. In the latter instance, the stamping of the blanks 36 will take place in a separate station.

The following examples will further illustrate the sequence of steps and step sequence modification that may be performed according to the invention.

EXAMPLE 1

Step 1: suitable can cover sheet metal such as oiled sheet metal of the thinnest gage suitable for the purpose is unwound from coils as received from the mill.

Step 2: the openings 33 or patterns of openings are stamped, preferably by the use of so-called multiple tools.

Step 3: the sheet metal, if necessary, after a preliminary degreasing step, is immersed into an alkaline immersion bath and later subjected to a brushing operation for mechanically removing any solid contaminations from the sheet metal. During the immersion an electrolytic degreasing takes place. Preferably the bath may be operated in accordance with the so-called neutral wire method. The deburring takes place during the cleaning operation due to the increased current density at the burrs and sharp edges. The parameter of the current or rather current density depends from the size of the burrs to be removed. According to the invention the burrs are measured or sensed and the respective burr size values are used for electronically or manually controlling the current density in the bath.

Step 4: the sheet metal is rinsed, pickled, rinsed again, and then brushed.

Step 5: the sheet metal is then plated either by a chromium plating or tin plating step, whereby the deburred edges are completely coated.

Step 6: the sheet metal is provided with a protective lacquer coating preferably in a roller type lacquer application, whereby the stamping edges are also coated by capillary action.

Step 7: the cover blanks with the desired shape or profile are produced by a molding type of stamping, whereby the individual blanks may be simultaneously severed from the sheet metal band or panel. In the alternative, the band may be severed into strips for subsequent blank stamping.

EXAMPLE 2

Step 1: sheet material, preferably in the form of coils, is already chromium plated prior to any stamping operation.

Step 2: the openings, for example, in the form of hole patterns are stamped into the sheet metal, preferably with a multiple tool.

Step 3: the deburring of the stamping burrs takes place in accordance with Step 3 of Example 1, whereby the preliminary degreasing and the subsequent brushing are obviated due to the prior chromium plating.

Step 4: the sheet material is subjected to a subsequent chromium plating step for covering the stamping edges and surfaces.

Step 5: the Steps 6 and 7 of Example 1 are repeated.

EXAMPLE 3

Instead of using steel or iron sheet material, aluminum sheet material is used, preferably in the form of coils as delivered from the mill. Instead of the subsequent chromium plating step after the stamping, the blanks are "passivated" which is accomplished by conventional anodizing.

Incidentally, an alkaline bath composition for use in connection with steel or aluminum sheet material may be as follows:

Tetraethyl ammonium hydroxide (1–5% by weight)+detergent (0,01% by weight) or,

Ammonium carbamate (1–5% by weight)+detergent (0,01% by weight).

A suitable current density may be adjusted within the range of 10–40 Ampère per $dm^2$ (current density) or 5–15 Coulomb per $dm^2$ (quantity of electricity), depending on the thickness of the sheet metal and on the size of the burrs the treatment duration is preferably within the range of 0.5–3 sec (in continuous operation).

Although the invention has been described with reference to specific example embodiments, it will be appreciated, that it is intended to cover all modifications and equivalents within the scope of the appended claims.

What is claimed is:

1. A method for manufacturing sheet metal covers for containers, such as cans, in a continuously progressing operation, comprising the following steps:

(a) moving a sheet metal such as a band from a coil or a sheet from a stack into a stamping station, (b) stamping holes into the sheet metal in predetermined locations so that the holes will be located in said covers and so that each stamped hole has a sharp edge adjacent the top surface of the sheet metal and a burred edge adjacent the bottom surface of the sheet metal, (c) moving the stamped sheet metal with the holes therein through an electrolytic immersion bath for cleaning the sheet metal and for simultaneously chamfering said sharp edge and said burred edge by means of an increased electrolytical current density at these edges, (d) subjecting the sheet metal to a cleaning operation, (e) plating the cleaned sheet metal whereby the chamfered edges are also coated, and (f) stamping the covers out of the sheet metal so that the previously stamped holes are located in the covers.

2. A method for manufacturing sheet metal covers for containers, such as cans, in a continuously progressing operation, comprising the following steps:

(a) moving sheet metal such as a band from a coil or a sheet from a stack into a stamping station, (b) stamping holes into the sheet metal in predetermined locations so that the holes will be located in said covers and so that each stamped hole has a sharp edge adjacent the top surface of the band and a burred edge adjacent the bottom surface of the band, (c) coating the sheet metal with a protective coating which is not attacked by an electrochemical treatment except at said sharp edges and except at said burred edges for limiting an electrochemical removal treatment to said sharp edge and to said burred edge, (d) moving the stamped and coated sheet metal through an electrolytic immersion bath for said electrochemical treatment for cleaning the sheet metal and for simultaneously chamfering said sharp edge and said burred edge by means of an increased electrolytical current density at these edges, (e) subjecting the sheet metal to a cleaning operation, and (f) stamping the covers out of the sheet metal so that the previously stamped holes are located in the covers.

3. The method of claim 2, wherein said covering step is a plating step.

4. A sheet metal cover for a can produced by the method of claim 1 or 2.

* * * * *